US005182601A

United States Patent [19]

Hodoshima et al.

[11] Patent Number: 5,182,601

[45] Date of Patent: Jan. 26, 1993

[54] IMAGE FORMING APPARATUS HAVING TONER HANDLING UNITS WHICH ARE ALTERNATIVELY USABLE AS A DEVELOPING DEVICE OR A CLEANING DEVICE

[75] Inventors: Takashi Hodoshima, Kawasaki; Shunji Katoh, Sagamihara, both of Japan

[73] Assignee: Ricoh Company, Ltd., Tokyo, Japan

[21] Appl. No.: 658,383

[22] Filed: Feb. 20, 1991

[30] Foreign Application Priority Data

| | | | |
|---|---|---|---|
| Feb. 20, 1990 | [JP] | Japan | 2-37461 |
| Jun. 13, 1990 | [JP] | Japan | 2-154238 |
| Jan. 16, 1991 | [JP] | Japan | 3-3293 |

[51] Int. Cl.[5] ..... G03G 15/09; G03G 21/00

[52] U.S. Cl. ..... 355/270; 355/305; 355/245

[58] Field of Search ..... 355/270, 305, 245, 210, 355/296

[56] References Cited

U.S. PATENT DOCUMENTS

| | | | |
|---|---|---|---|
| 3,647,293 | 3/1972 | Queener . | |
| 3,700,328 | 10/1972 | Davidge et al. | 355/305 |
| 4,142,165 | 2/1979 | Miyakawa et al. | 355/305 |
| 4,185,910 | 1/1980 | Nomura et al. | 355/305 |
| 4,240,723 | 12/1980 | Forgo . | |
| 4,465,360 | 8/1984 | Yamagishi et al. . | |
| 4,466,379 | 8/1984 | Nishimura | 118/658 |
| 4,876,572 | 10/1989 | Nagatsuna | 355/210 |
| 4,885,223 | 12/1989 | Enoki et al. | 430/122 |

OTHER PUBLICATIONS

Abstract of Japanese Kokai 62-31865, Patent Published Feb. 10, 1987.

*Primary Examiner*—Richard L. Moses

*Attorney, Agent, or Firm*—Oblon, Spivak, McClelland, Maier & Neustadt

[57] ABSTRACT

Image forming apparatus having two identical toner handling units each functioning as a developing device when located in a developing position or as a cleaning device when located in a cleaning position. The image forming devices are alternately and repetitively set in the developing position and cleaning position.

3 Claims, 15 Drawing Sheets

IMAGE FORMING APPARATUS HAVING TONER HANDLING UNITS WHICH ARE ALTERNATIVELY USABLE AS A DEVELOPING DEVICE OR A CLEANING DEVICE

BACKGROUND OF THE INVENTION

The present invention relates to a copier, facsimile transceiver, printer or similar image forming equipment having an image carrier, a developing device, and a cleaning device.

One of predominant types of image forming equipment available today forms a latent image electrostatically on an image carrier such as a photoconductive element, develops the latent image by a developing device to produce a toner image, transfers the toner image to a recording medium, and removes toner particles which remain on the image carrier after the image transfer by a cleaning device. In this type of image forming equipment, the developing device needs maintenance including the supply of toner and replacement of developer, while the cleaning device needs maintenance including the disposal of collected or waste toner. These two kinds of maintenance are effected at intervals which depend on the capacity of the equipment; the smaller the size of the equipment, the shorter the intervals. Handling a toner, for example, is awkward since the toner is apt to smear the operators hands, clothing and ambience. In the light of this, a disposable process cartridge having a developing device, cleaning device and other devices implementing the image forming process integrally therein has been proposed. A disposable developing device and a disposable cleaning device have also been proposed in the past. Although these disposal schemes may be useful for operators, they are contradictory to the current trend toward the reuse of resources since all the component parts including those which are still usable have to be discarded.

To postpone the time for disposal, two image forming units each having a developing device and a cleaning device may be installed in an image forming apparatus symmetrically to each other with respect to the axis of a photoconductive drum, or image carrier, as disclosed in Japanese Patent Laid-Open Publication No. 31865/1987. In such apparatus, one of the two image forming units is located in the developing position of the image carrier while the other is located in the cleaning position of the same. The image forming unit located in the developing position and the image forming unit located in the cleaning position have respectively the developing device and the cleaning device thereof rendered effective, i.e., only one developing device and only one cleaning device are operated at a time. When the developer stored in the developing device of one image forming unit deteriorates or when the ability of the cleaning device is lowered, the two units are removed from the equipment, replaced with each other, and then mounted again on the apparatus. Then, the other developing device and the other cleaning device which are fresh are used.

The problem with the above-described interchangeable unit approach is that the developing device of one image forming unit and the cleaning device of the other image forming unit are not operated while the others are operated, wasting substantial part of the limited space available in the apparatus. Further, the toner collected by the cleaning device of each image forming unit is simply discarded. This is undesirable from the standpoint of effective use of toner.

SUMMARY OF THE INVENTION

It is therefore an object of the present invention to provide an image forming apparatus having a developing device and a cleaning device which are interchangeable, easy and efficient to maintain, and usable over a long period of time.

In accordance with the present invention, in image forming apparatus having an image carrier for forming a latent image electrostatically thereon, a developing device for developing the latent image to produce a toner image, and a cleaning device for removing a toner which remains on the image carrier after the transfer of the toner image to a recording medium, the developing device and the cleaning device each comprises a toner handling unit. The toner handling unit comprises an image forming roller for forming a magnet brush by a toner, a toner collecting roller for collecting the toner from the image forming roller, a toner storing member for storing the toner and accommodating an agitating roller, and a toner supply roller for feeding the toner stored in the toner storing member to the image forming roller. The toner handling unit implemented as the developing device functions as the cleaning device when located in a cleaning position while the toner handling unit implemented as the cleaning device functioning as the developing device when located in a developing position.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
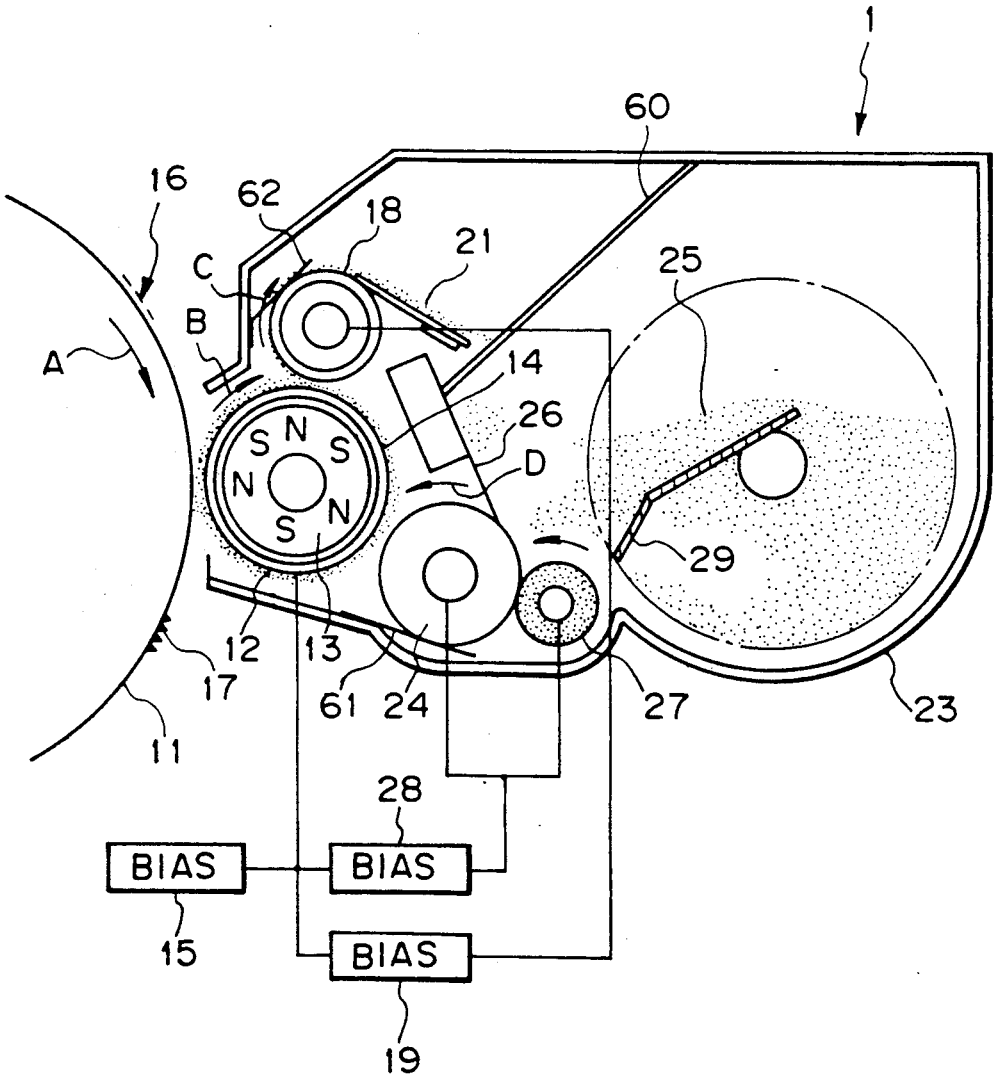
FIG. 1 is a fragmentary section of an image forming apparatus embodying the present invention.

Referring to FIG. 1 of the drawings, an image forming equipment apparatus embodying the present invention is shown and includes an image carrier in the form of a photoconductive drum 11. The drum 11 is rotatable in a direction indicated by an arrow A in the figure. An toner handling unit, generally 1, is located in close proximity to the drum 11 and has a cylindrical sleeve 12 which is made of aluminum or similar non-magnetic material. Magnets 13 are disposed in the sleeve 12 and arranged such that opposite magnetic poles alternate with each other. The magnets 13 are spaced apart from the inner periphery of the sleeve 12 by a predetermined distance. A magnet brush 14 is formed on the outer periphery of the sleeve 12 by the force of the magnets 13. While the sleeve 12 and/or the magnets 13 are rotated, the magnet brush 14 is transported in a direction indicated by an arrow B in the figure. The assembly of the sleeve 12 and magnets 13 will sometimes be referred to as an image forming roller in the specification.

Assume that the image forming device 1 is located in a developing position to play the role of a developing device. Then, a bias voltage for development which is the same in polarity as the drum 11 is applied from a power source circuit 15 to the sleeve 12. The magnet brush 14 formed on the sleeve 12 contacts the drum 11 which carries an electrostatic latent image thereon. As a result, a toner is transferred from the magnet brush 14 to the latent image to produce a visible image or toner image 17. In the illustrative embodiment, by providing the sleeve 12 with an outside diameter of 20 millimeters and a surface magnetic force of about 900 gausses, it is possible to form a magnet brush 14 which is 0.3 millimeter to 5 millimeters high (preferably 0.7 millimeter to 2 millimeters). The bias voltage serves to free the background area of an image from contamination and to adjust the image density. Specifically, when the latent image has a potential of −800 volts and undergoes non-inverted development, the bias voltage should preferably be about 0 volt to about −500 volts. In the event of inverted development, it is desirable to use a negatively charging toner and a bias voltage of about −200 volts to about −800 volts. In practice, the bias voltage will be determined in conformity to the image density or as desired by the user.

A toner collecting roller 18 is disposed above the sleeve 12 to remove the toner which remains on the magnet brush 14 after the development. The toner collecting roller 18 is held in contact with the magnet brush 14 and applied with a predetermined bias voltage for toner collection. The bias voltage applied to the toner collecting roller 18 has substantially the same level as the developing potential, i.e., a level capable of developing the entire surface when the roller 18 is assumed to be an image carrier. For example, when the potential of the latent image is −800 volts and the bias voltage for development is −200 volts, the bias voltage for collection may be about −600 volts. The roller 18 is rotated in a direction indicated by an arrow C to prevent the toner which it has collected from being again deposited on the magnet brush 14. A blade 21 is associated with the roller 18 to scrape the collected toner off the roller 18. The toner so scraped off by the blade 21 is returned to a toner collecting member such as a toner tank 23.

A toner supply roller 24 serving as toner supply means is located below the sleeve 12, i.e., in a downstream portion of the magnet brush 14 and held in contact with the magnet bush 14. The toner supply roller 24 is pressed against a sponge roller 27 which helps the roller 24 supply a toner. A drive mechanism, not shown, drives the toner supply roller 24 in a rotary motion, as indicated by an arrow D in the figure. The toner supply roller 24 drives a toner 25 stored in the toner tank 23 toward the magnet brush 14. Another function of the toner supply roller 24 is to regulate the height of the magnet brush 14 and to thereby eliminate an irregular image density distribution. A blade 26 is associated with and pressed against the toner supply roller 24. In this configuration, the toner 25 is deposited on the roller 24 in a uniform thin layer and charged by friction. To enhance the regulation of the height of the magnet brush 14, a blade, roller or similar extra regulating member may be disposed between the developing position and the position where the sleeve 12 contacts the roller 24 and in close proximity to the sleeve 12.

A power source circuit 28 applies a predetermined bias voltage for toner supply to the toner supply roller 24, so that the toner 25 may be fed to the magnet brush 14 in a desirable manner. This bias voltage has the same polarity as the charged toner and is selected to be about 0 volt to about 600 volts. When the bias voltage for toner collection is opposite in polarity to the charged toner, the toner will be surely retained on the toner supply roller 24. Preferably, the bias voltage for toner collection is lower than the bias voltage for development. Assume that the sleeve 12, toner collecting roller 18 and toner supply roller 24 are respectively applied with voltages VB, VR and VD each being opposite in polarity to the toner. Then, to surely retain the toner on the sleeve 12, the voltages VB, VR and VD should preferably be related to one another, as follows:

$$|VR| > |VB| > |VD|$$

Further, to maintain the toner density on the sleeve 12 uniform, the following relation is desirable:

$$|VB| - |VD| > |VR| - |VB|$$

The toner collecting roller and toner supply roller 24 each may be made of metal, conductive rubber or similar material capable of providing an electric bias effect between the roller 18 or 24 and the sleeve 12. The rollers 18 and 24 each are located so as to contact the sleeve 12 over 50 percent to 100 percent of the height of the magnet brush 14. If the absolute value of the air gap is less than 1 millimeter, the rollers 18 and 24 may contact the sleeve 12 over more than 100 percent of the height. In such a case, use has to be made of electric biasing means. While the rollers 18 and 24 may have any desired outside diameters, it is preferable that the outside diameters each be less than 80 percent of the outside diameter of the sleeve 12 or 5 millimeters to 60 millimeters in absolute value (desirably 8 millimeters to 40 millimeters) from the miniaturization standpoint.

Not all of the toner transferred to the magnet brush 14 contributes to the development. Specifically, the amount of toner deposition on the drum 11, i.e., the image density depends on the rotation speed of the toner supply roller 24, i.e., the toner transfer speed to the magnet brush 14. It follows that a sufficient image density is achievable if the rotation speed of the toner supply roller 24 is increased to supply the toner at a higher speed than the transport speed of the magnet brush 14. To increase the toner supply speed, the specifications of a gearing, not shown, which connects a drive source to the roller 24 may be changed or, alternatively, the outside diameter of the roller 24 may be increased.

In operation, the toner 25 in the toner tank 23 is retained on the toner supply roller 24 due to the rotation of the roller 24. The toner on the roller 24 is charged by friction while being regulated to a predetermined thickness by the blade 26. The toner is transferred from the roller 24 to the magnet brush 14 at a speed at least higher than the transport speed of the magnet brush 14 and under the application of a predetermined bias voltage for toner supply. Further, the toner is transferred from the magnet brush 14 to the drum 11 to develop a latent image electrostatically formed on the drum 11. After the development, the toner on the magnet brush 14 has an irregular density distribution associated with the image. The toner remaining on the magnet brush 14 in such a distribution is collected by the toner collecting roller 18, whereby the irregular density distribution is eliminated. More specifically, after the toner collection, the magnet brush 14 moves away from the toner collecting roller 18 toward the toner supply side while being constituted by a carrier only or with a uniform toner density distribution. As shown in FIG. 1, a toner agitating roller or agitator 29 may be disposed in the toner tank 23 to eliminate toner blocking which is apt to occur when a great amount of toner is stored in the tank 23, thereby enhancing the stability of images.

Figure 2:
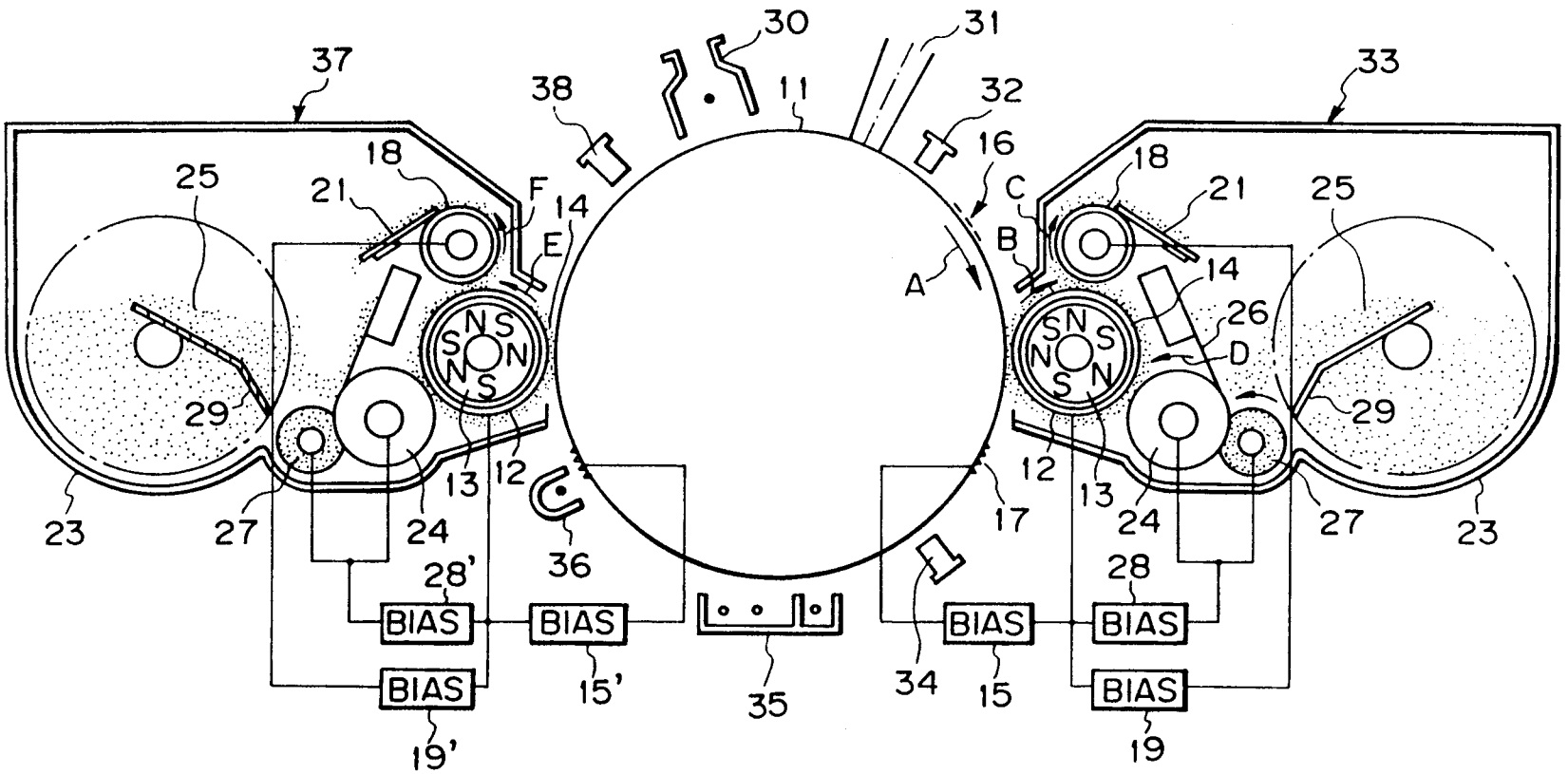
FIG. 2 is a fragmentary section of image forming apparatus implemented with toner handling units each having the construction shown in FIG. 1.

The image forming device 1 may be implemented as a cleaning apparatus, as follows. As shown in FIG. 2, a photoconductive drum 11 is charged by a charger 30 and then exposed imagewise by light 31 to form a latent image electrostatically thereon. An eraser 32 dissipates the charge deposited in the non-image area of the drum 11. A developing device 33 develops the latent image by a toner. Thereafter, a pretransfer discharging unit (PTL) 34 discharges the drum 11, and then a transfer/separation charger 35 transfers the developed image to a recording medium, not shown. A precleaning charger (PCC) 36 discharges the drum 11, and then a cleaning apparatus 37 cleans the surface of the drum 11 undergone the image transfer. Finally, a discharging unit 38 discharges the entire surface of the drum 11. The toner handling unit 1 shown in FIG. 1 is usable as any of the developing device 33 and cleaning device 37. As shown in FIG. 2, the developing device 33 and cleaning device 37 can be provided with an identical configuration. Therefore, two toner handling units 1 are located at opposite sides of the drum 11 and symmetrically to each other with respect to the axis of the drum 11. The toner remaining on the drum 11 after the image transfer is removed by the PCC 36 to enhance the cleaning ability. The PCC 36 superposes a DC voltage on an AC voltage to charge the remaining toner to particular polarity, e.g. positive polarity. For example, use may be made of AC 150 $\mu$A and DC 15 $\mu$A. The toner positively charged by the PCC 36 is removed from the drum 11 by the magnet brush 14 which is formed on the sleeve 12 by the magnets 13 included in the cleaning device 37. A bias voltage of about −150 volts is fed from a power source circuit 15' to the sleeve 12 which is rotated in a direction indicated by an arrow E. The toner transferred from the drum 11 to the sleeve is collected by the toner collecting roller 18. A predetermined bias voltage for toner collection of −500 volts, for example, is fed from a power source circuit 19' to the toner collecting roller 18. The roller 18 is driven in a rotary motion as indicated by an arrow F. The toner on the roller 18 is scraped off by the blade 21 and then returned to the toner tank 23.

When the toner handling unit 1 is located at the developing position to serve as the developing device 33, the toner supply roller 24 and sponge roller 27 coactive with the roller 24 play the role of means for supplying the toner from the toner tank 23 to the sleeve, or developing roller, 12. On the other hand, when the unit 1 is situated at the cleaning position to serve as the cleaning device 37, the drive transmission to the toner supply roller 24 is interrupted by a clutch, for example. In this case, a bias voltage equal to the bias voltage applied to the sleeve 12 (about −150 volts) is applied from a power source circuit 28' to the toner supply roller 24. The toner supply roller 24 serves to regulate the magnetic brush 14 to a predetermined height.

The various parts constituting the toner handling device 1 shown in FIG. 1 and serving as any of the developing device 33 and cleaning device 37 are accommodated in a single casing, i.e., constructed into a single removable unit. The toner handling unit 1 may be referred to as a developing-cleaning or developer-cleaner (D-C) device in distinction from a conventional developing device.

How toner handling units 1 each having the above construction are used as the developing device 33 and cleaning device 37 will be described specifically.

The user of the image forming equipment sets two new toner handling units 1, for example, in the apparatus, one at the developing position and the other at the cleaning position. Let the units 1 set in the developing position and cleaning position be referred to as a first and a second unit, respectively. When the first unit runs out of toner, i.e., in a toner end condition, the first and second units are replaced with each other. Then, the second unit whose toner tank contains a toner collected from the drum 11 is ready to develop an image. As soon as the second unit runs out of toner, the first and second units are again replaced with each other. At this time, the first apparatus will have collected the toner in the toner tank thereof. In this manner, the first and second units are repetitively used while being interchanged with each other. When both of the first and second units run out of toner, a new or third unit identical in construction with the first and second units is set in the developing position. In this case, the first or the second unit is placed in the cleaning position. For example, when the first unit is operated in the cleaning position until it degrades, it will be discarded and replaced with the second unit. If desired, both of the first and second units may be replaced with new devices when the toner remaining therein is scarce. Preferably, a new unit to be used in the developing position has the toner tank thereof loaded with as much toner as possible. Also, if a unit to be used in the cleaning position first has its toner tank loaded with a fresh toner beforehand such that the fresh toner and the collected toner will fill the toner tank, the unit will be efficiently used as the developing device 33.

Using the image forming devices 1 in the above-described manner is successful in eliminating the need for conventional toner supply which relies on a toner cartridge. Since the collected toner is used again, a complicated mechanical arrangement including pipes and screws is not necessary. The devices 1 can be repetitively used until they deteriorate and will be discarded when the life of their component parts or that of the magnet brushes expires.

Figure 3:
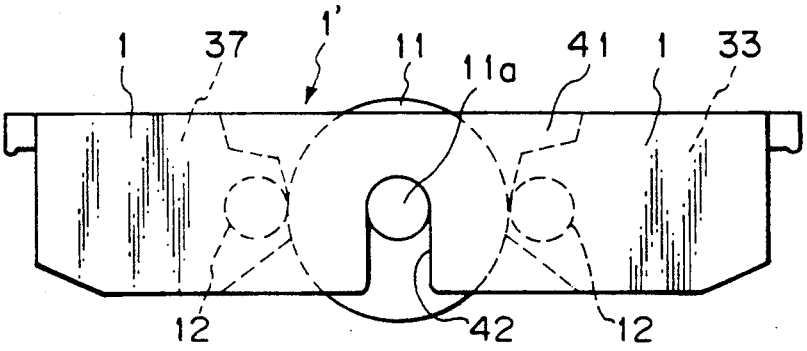
FIG. 3 is a fragmentary front view of an image forming apparatus having a developing device and a cleaning device constructed into a single cartridge.
Figure 4:
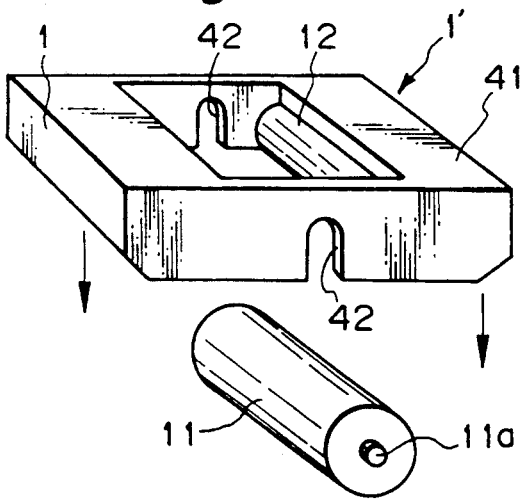
FIG. 4 is an exploded perspective view of the apparatus shown in FIG. 3.

While the image forming devices playing the roles of developing device 33 and cleaning device 37, respectively, have been shown and described as being constructed into independent units, they may be implemented as a single image forming cartridge 1', as shown in FIGS. 3 and 4. Specifically, the two image forming devices 1 are accommodated in a single casing 41 such that their sleeves 12 face the drum 11. The casing 41 has a notch 42 for receiving a shaft 11*a* on which the drum 11 is mounted. As shown in FIG. 3, when the casing 41 is mounted from above the drum 11, for example, the developing device 33 and cleaning device 37 are set in predetermined positions at the same time. To provide the devices 1 with interchangeability, it is preferable that the casing 41 and the two devices 1 be symmetrical with respect to a plane containing the axis of the drum 11, e.g. a vertical plane. When the device 1 serving as the developing device 33 runs out of toner, the casing 41 will be lifted by hand, turned to interchange the opposite devices 1 thereof, and then mounted again on the drum 11.

Figure 5:
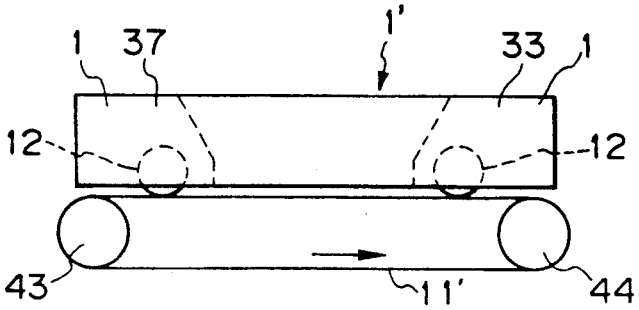
FIG. 5 is a fragmentary front view of an image forming apparatus having an image carrier in the form of a photoconductive belt.

The illustrative embodiment is also practicable with a photoconductive element in the form of a belt, as shown in FIG. 5. As shown, a photoconductive belt 11' is passed over rollers 43 and 44. If an arrangement is made such that the developing device 33 and cleaning device 37 perform their expected operations in positions where they face the straight run of the belt 11', the cartridge 1', FIG. 3, having two image forming devices 1 therein is usable. In this case, the image forming rollers 12 of the two devices 1 are not located to face each other as shown in FIG. 3, but they are exposed to the outside at the lower (or upper) end of the cartridge 1' so as to contact the belt 11', as shown in FIG. 5.

Figure 6:
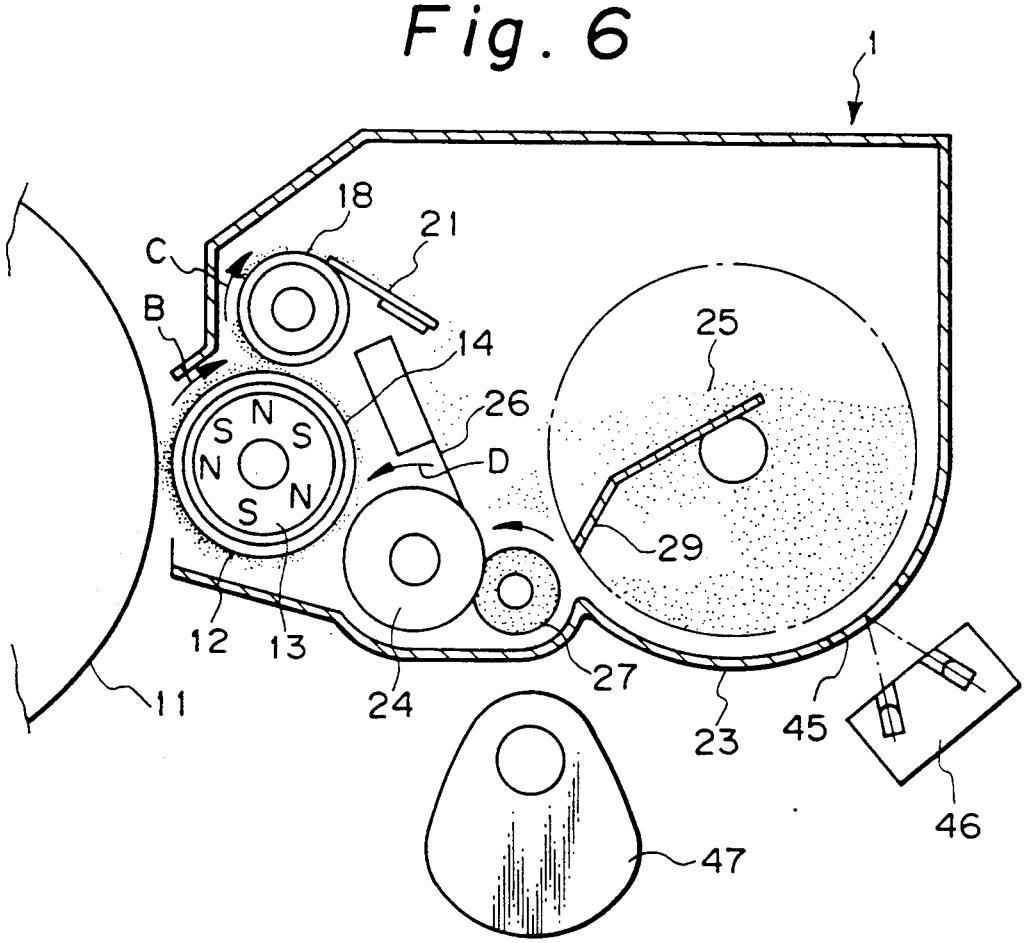
FIG. 6 is a fragmentary section of an image forming apparatus implemented with a modified form of the toner handling unit shown in FIG. 1.
Figure 7:
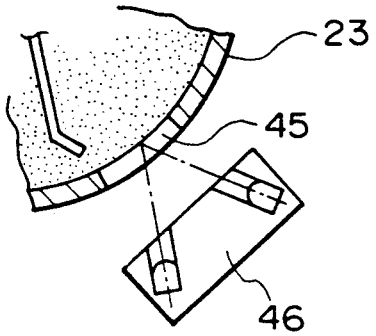
FIG. 7 is a view showing a specific arrangement of toner sensing means.
Figure 8:
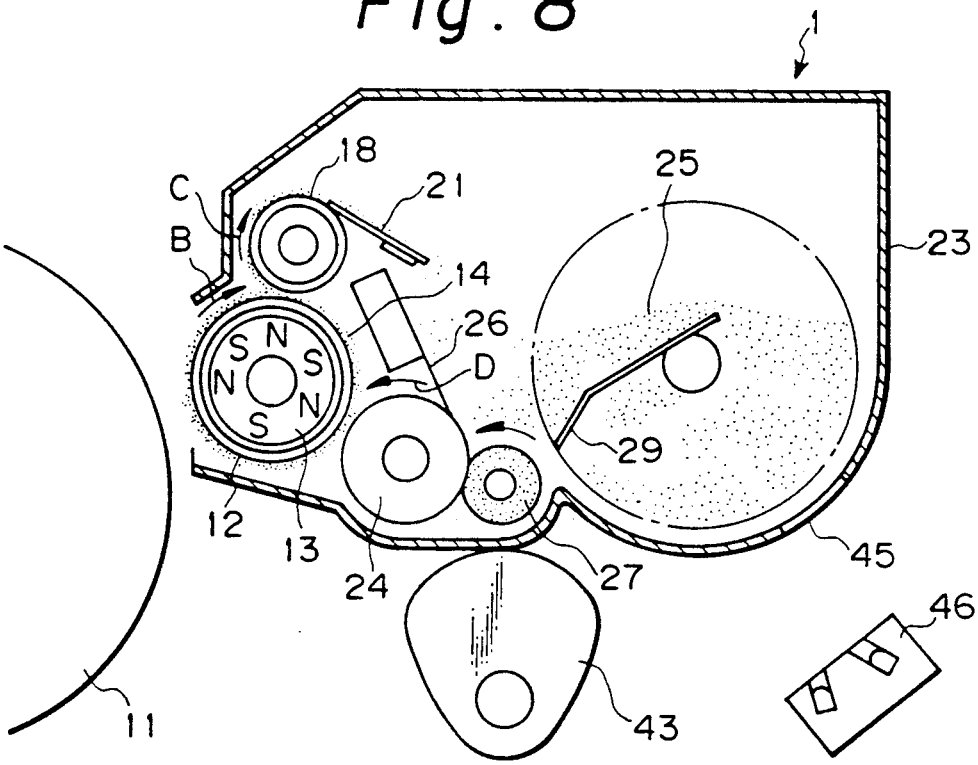
FIG. 8 is a section showing a condition in which the toner handling unit of FIG. 6 is released from the image carrier.

Referring to FIG. 6, an alternative embodiment of the present invention is shown which is implemented with a modified form of the image forming device 1. As shown, the device 1 which is located at the developing position has a transparent window 45 in a lower portion of the toner tank 23. The window 45 may be formed in a casing which constitutes the toner tank 23. Toner sensing means in the form of a reflection type photosensor 46 is mounted on the body of the equipment and positioned to face the transparent window 45. As shown in FIG. 7, while a light emitting element included in the photosensor 46 emits light to the interior of the toner tank 23 via the window 45, a reflection from the toner 25 is incident to a light-sensitive element also included in the photosensor 46. Whether or not the toner 25 is present and whether or not it is short is determined on the basis of the reflection incident to the light-sensitive element. The device 1 is left in the developing position so long as the reflection indicates that a sufficient amount of toner exists in the device 1. When the reflection indicates that the amount of toner remaining in the device 1 is short or zero, it causes a controller, shown, to rotate a cam 47 which is disposed below the device 1. Then, as shown in FIG. 8, the cam 47 raises the device 1 away from the drum 11 to an inoperative position.

Figure 9:
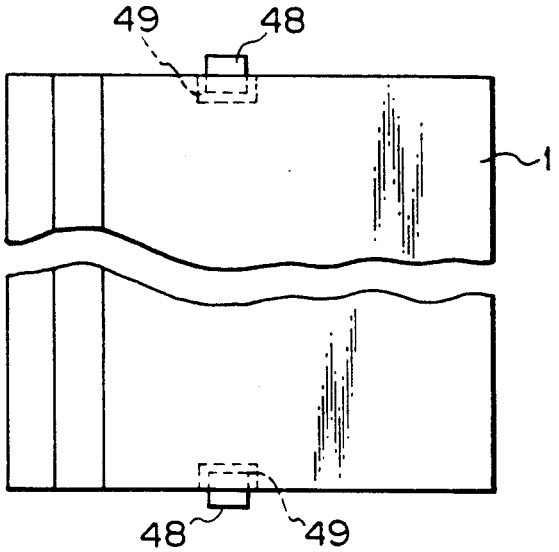
FIG. 9 is a plan view showing another modified form of the toner handling device.
Figure 10A:
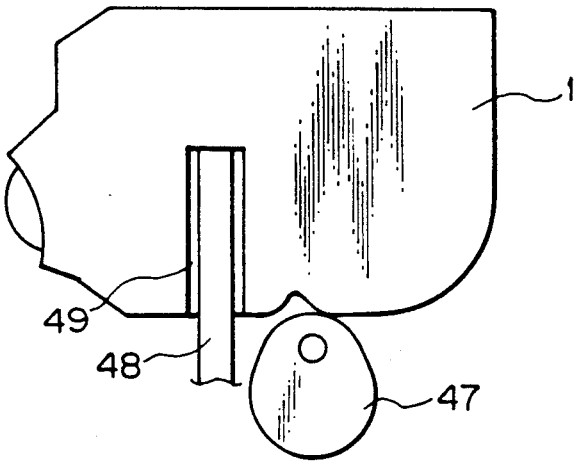
FIG. 10A is a front view showing the toner handling unit of FIG. 9 which is held in contact with the image carrier.
Figure 10B:
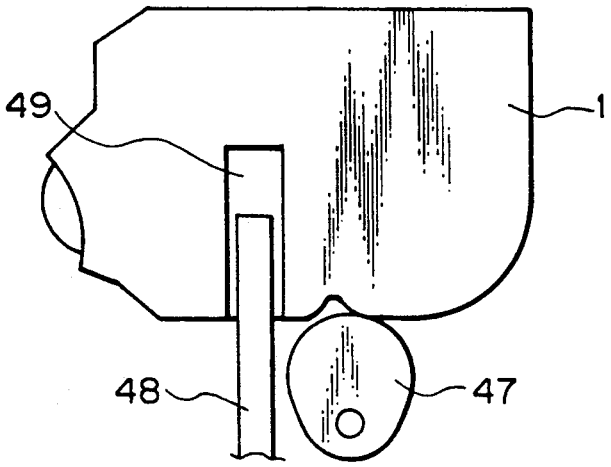
FIG. 10B is a view similar to FIG. 10A, showing the toner handling unit which is released from the image carrier.
Figure 11:
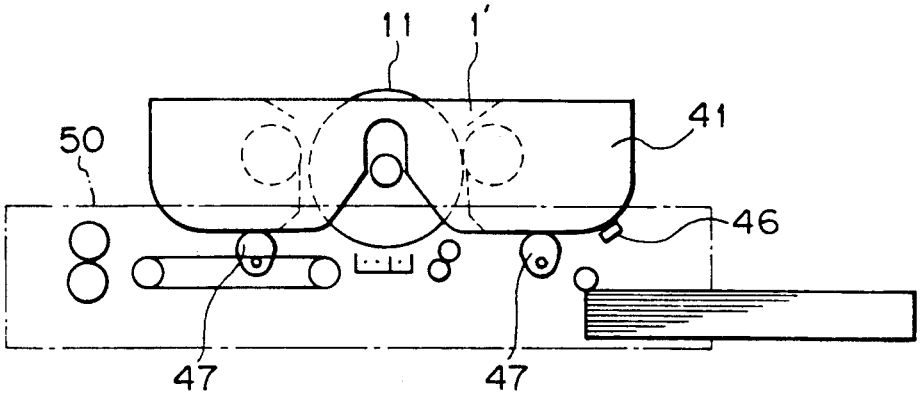
FIG. 11 is a fragmentary section of image forming equipment implemented with another specific configuration of the toner handling unit.

FIGS. 9 to 11 show specific safety implementations for protecting the drum 11 from damage in the event when the image forming device 1 is raised by the cam 47, as mentioned above. In FIGS. 9, 10A and 10B, the casing of the device 1 is provided with guide channels 49 on opposite side walls thereof, while the equipment body is provided with guides 48. When the device 1 is mounted on the equipment body, e.g., in the developing position, the guides 48 slide in the associated guide channels. When the cam 47 is rotated, the device 1 is moved along the guides 48 and, therefore, prevented from contacting the drum 11. As shown in FIG. 11, two image forming devices 1 may be constructed into a single cartridge 1' so that they may be set at the developing position and cleaning position at the same time. Preferably, cams 47 are provided for raising the entire cartridge 1' when the output of the photosensor 46 indicates that the amount of remaining toner is short or zero. The reference numeral 50 designates the body of the image forming equipment.

Figure 12:
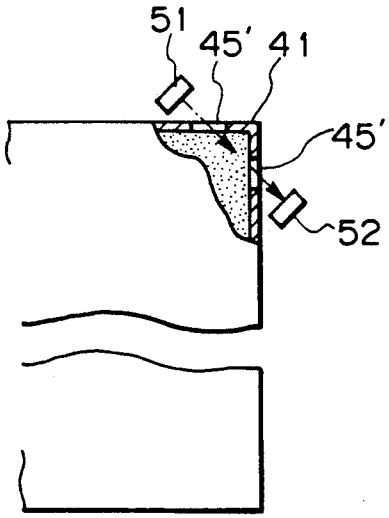
FIG. 12 is a view showing another specific configuration of the toner sensing means.

When the cartridge 1' is so configured as to be mounted from above the drum 11, an arrangement may be made such that upper part of the equipment body incorporates the cartridge 1' and is openable away from lower part. This kind of arrangement may be provided with a mechanism for inhibiting the upper part from being closed when the photosensor 46 indicates that the toner does not exist. FIG. 12 shows another implementation for sensing the amount of toner remaining in the toner tank 23. As shown, the casing 41 of the toner tank is formed with two transparent windows 45', and a light emitting element 51 and a light-sensitive element 52 are located to face each other with the intermediary of the windows 45'.

Figure 13:
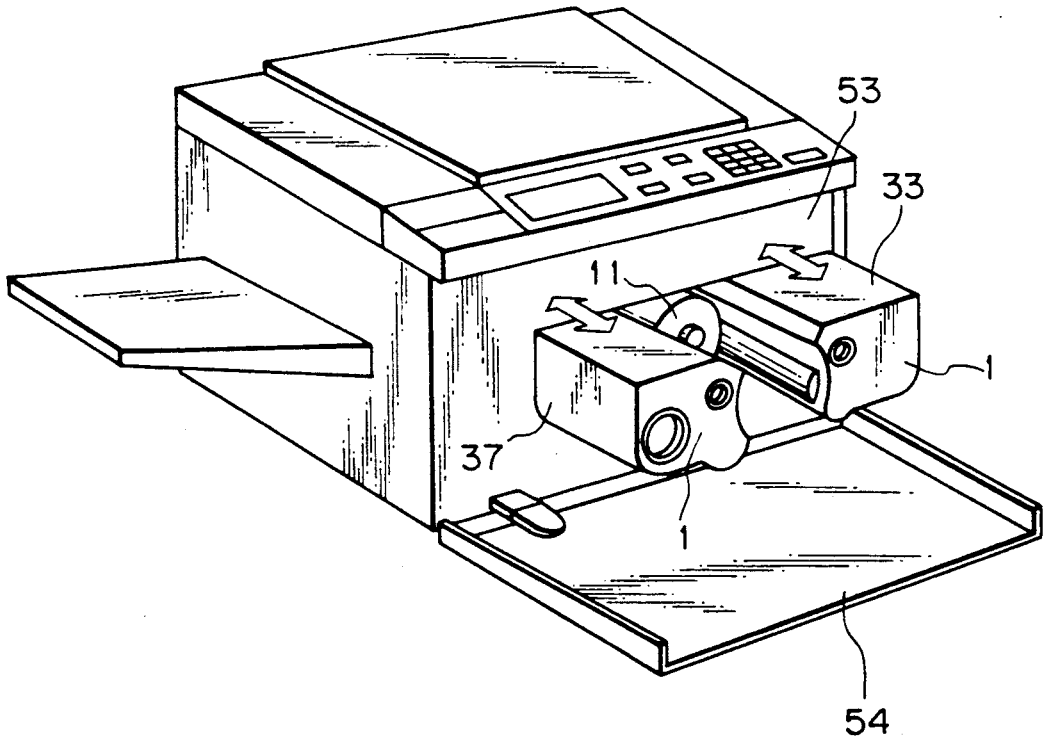
FIG. 13 is a perspective view of an image forming apparatus showing how toner handling units are mounted and dismounted.
Figure 14:
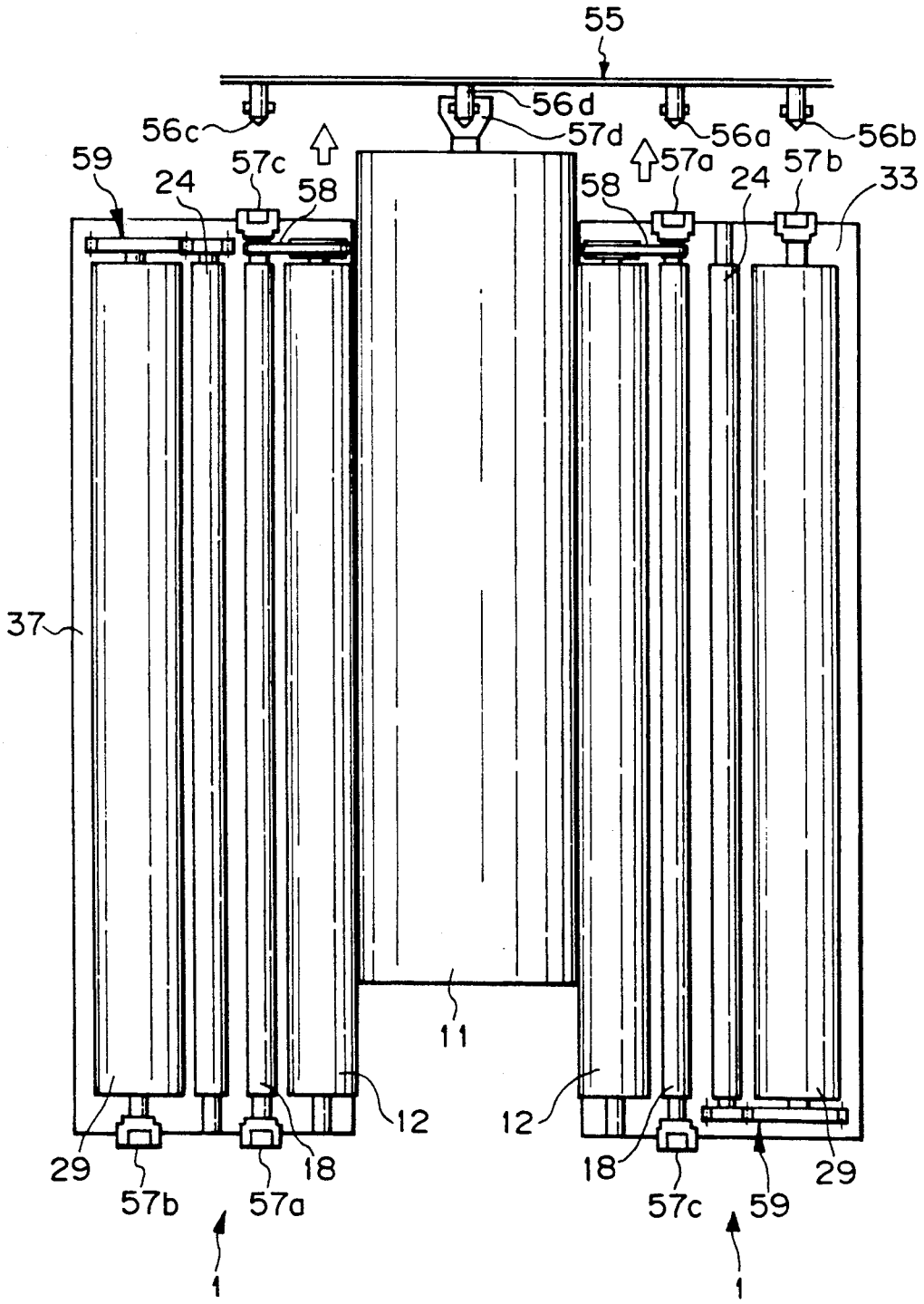
FIG. 14 is a schematic plan view representative of a relation between the toner handling units and image carrier shown in FIG. 13 and a drive mechanism mounted on the apparatus body.

Assume that the image forming devices 1 serving as the developing device 33 and cleaning device 37, respectively, are physically independent of each other, as shown in FIGS. 1 and 2. Then, as shown in FIG. 13, the equipment may be constructed such that the operator inserts or removes the two devices 1 at opposite sides of the drum 11 by opening a front cover 54 which forms part of an equipment housing 53, as indicated by arrows in the figure. As shown in FIG. 14, when the devices 1 are so inserted into the housing 53, they are operatively connected to a drive mechanism 55. Regarding the device 1 to be used as the developing device 33, the shaft of the toner collecting roller 18 is connected to a first drive shaft 56*a* of the mechanism 55 while the shaft of the agitator 29 is connected to a second drive shaft 56*b*. While the drive shafts 56*a* and 56*b* shown in FIG.

14 are respectively connected to the shaft of the roller 18 and the shaft of the agitator 29 by a first and a second coupling 57*a* and 57*b*, the couplings 57*a* and 57*b* each may be replaced with a gear. Regarding the device 1 used as the cleaning device 37, the shaft of the toner collecting roller 18 is connected to a third drive shaft 56*c* of the mechanism 55 by a coupling 57*c* or by a gear. Since the toner supply roller 24 of the cleaning device 37 should preferably be not rotated, it is isolated from the drive of the toner collecting roller 18 and sleeve 12 and is not connected to a drive shaft. The device 1 is used in one orientation when implementing the developing device 33 and in the other or opposite orientation when implementing the cleaning device 37, with respect to the longitudinal direction. Hence, the coupling 57, gear or similar connecting member is provided on opposite ends of the shaft of the toner collecting roller 18, while it is provided on only one end of the shaft of the agitator 29 since the agitator 29 does not have to be driven except during the developing operation. The drum 11 also has to be removable as an expendable in the event of replacement or maintenance. Therefore, the shaft of the drum 11 is operatively connected to a fourth drive shaft 56*d* of the mechanism 55 by a coupling 57*d* or similar connecting member.

Figure 15:
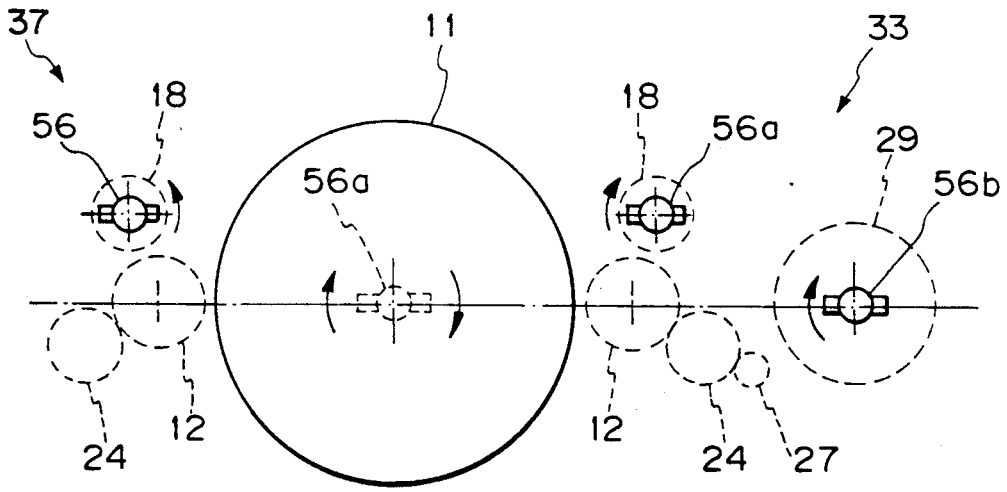
FIG. 15 is a front view schematically showing the drive line of the mechanism of FIG. 14.

FIG. 15 shows specific directions in which the shaft of the drum 11 and the various driven members of the developing device 33 and cleaning device 37, e.g., toner collecting rollers 18 and agitator 29 are rotated. In the figure, the drum 11 and the sleeve (developing roller) 12, toner collecting roller 18 and agitator 29 of the developing device 33 are rotated clockwise, while the toner supply roller 24 is rotated counterclockwise. In the cleaning device 37, the sleeve (cleaning roller) 12 and toner collecting roller 18 are rotated counterclockwise. The sleeves 12 each is connected to the associated toner collecting roller 18 by a belt 58, and the toner supply rollers 24 each is connected to the associated agitator 29 by gears 59. While the belt 58 and gears 59 may be located at either one of opposite ends of the device 1, the belts 58 are shown in FIG. 14 as being located at opposite sides relative to each other.

Figure 16:
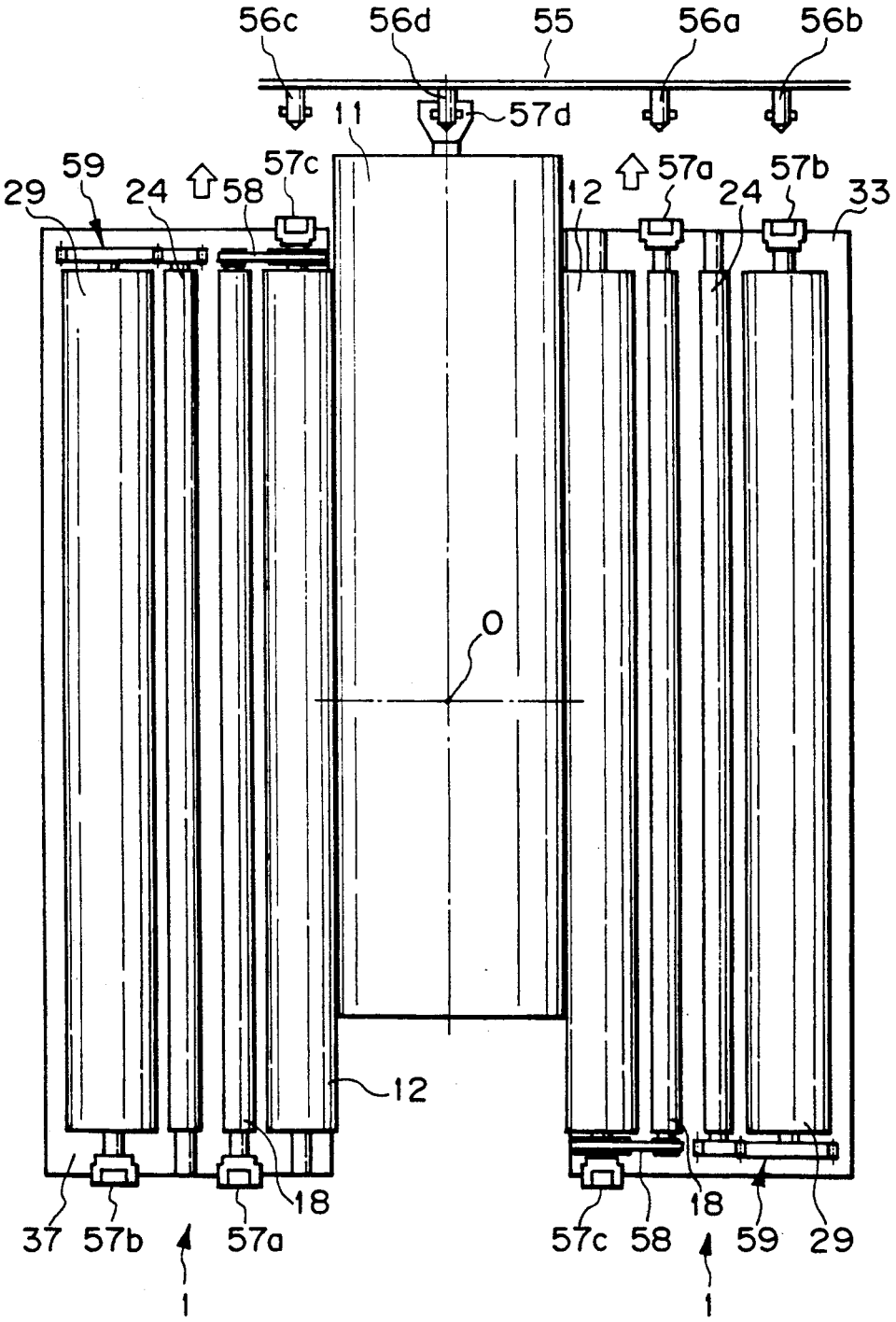
FIG. 16 is a plan view schematically showing a modification of the relation shown in FIG. 14.

Usually, magnets are accommodated in the sleeve 12 and arranged such that opposite poles alternate with each other. Since the magnets are usually fixed in position, providing a coupling or similar connecting member at opposite sides of the sleeve 12 for the connection thereof with the drive shafts 56*a* and 56*c* would complicate the structure. In the light of this, as shown in FIG. 16, such a connecting member may be provided on only one end of the sleeve 12. When the device 1 is used as the cleaning device 37, the coupling or similar connecting member 57*c* provided on the sleeve 12 is connected to the third drive shaft 56*c* while such a connecting member is not provided on the other end of the sleeve 12. Instead, the coupling or similar connecting member 57*c* is provided on the end of the toner collecting roller 18. On the other hand, when the device 1 plays the role of the developing device 33, the shaft of the toner connecting roller 18 is connected to the first drive shaft 56*a*. Alternatively, the connecting member of the sleeve 12 may be so positioned as to be connected to the drive mechanism 55 when the device 33 serves as the developing device 33. FIG. 16 shows a specific arrangement wherein both the belt 58 and the gears 58 are positioned on the same end as each other.

Figure 17:
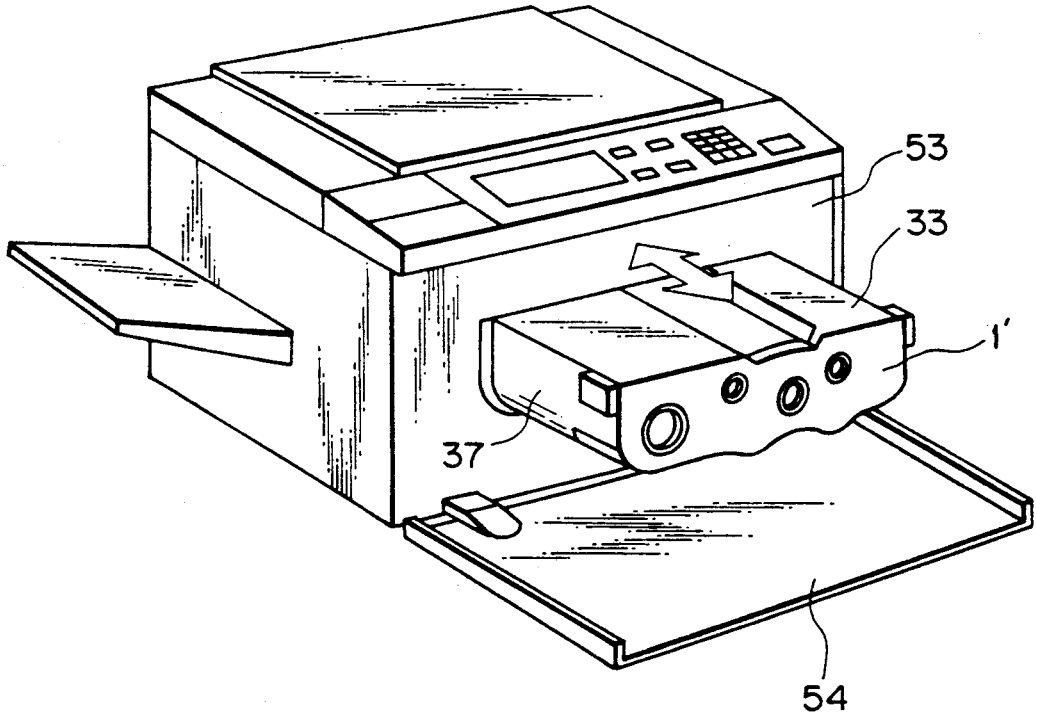
FIG. 17 is a perspective view similar to FIG. 13, showing two toner handling units constructed into a single unit.
Figure 18:
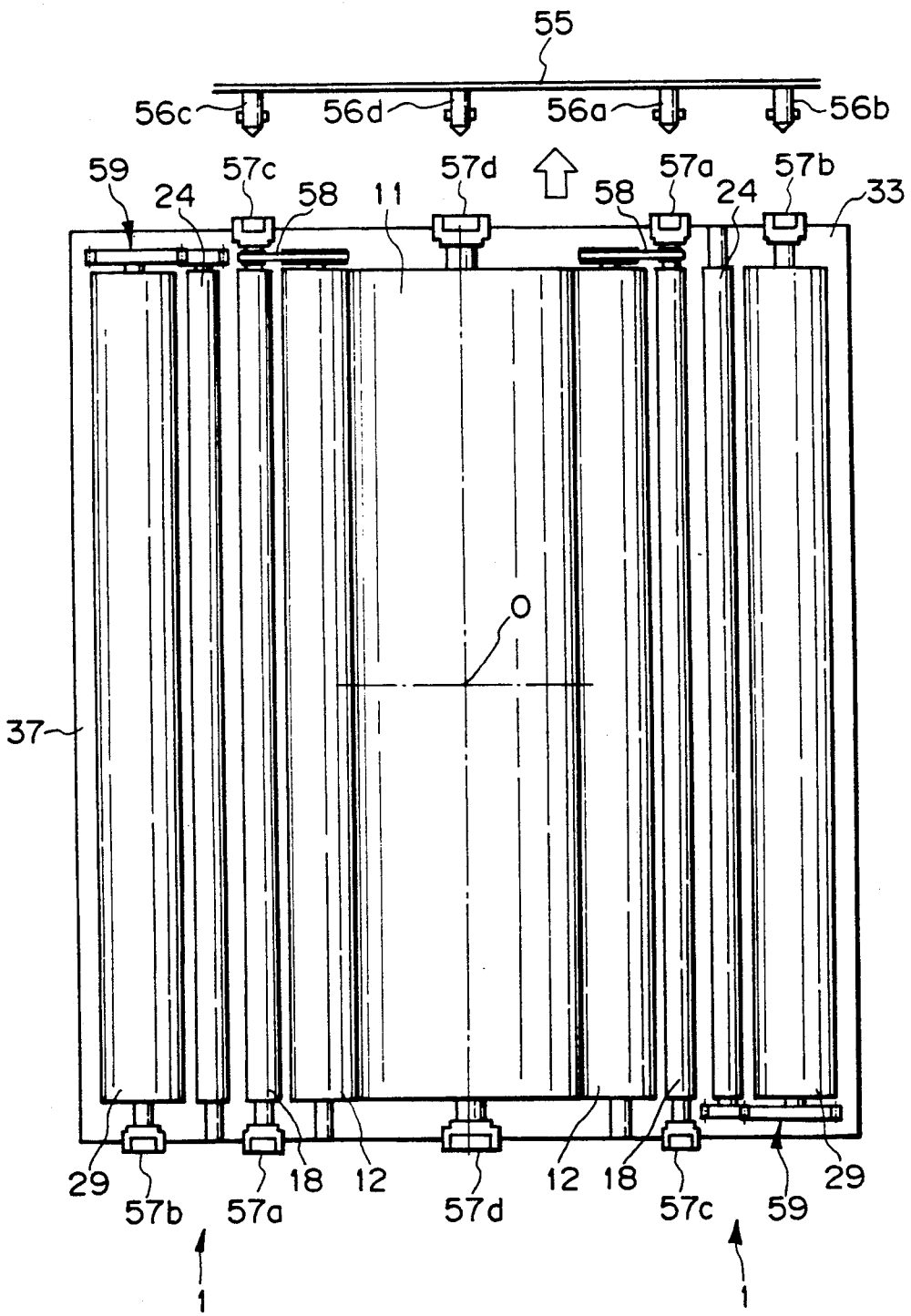
FIG. 18 is a view similar to FIG. 14 and associated with the arrangement of FIG. 17.

FIGS. 17 and 18 show a specific structure of the image forming equipment to which the cartridge 1' shown in FIG. 3 is applicable. As shown, the two devices 1 constructed into a unit or cartridge 1', i.e., the developing device 33 and cleaning device 37 are mounted or dismounted at the same time. The equipment FIGS. 17 and 18 are operable with the drive mechanism 55 having the drive shafts 56*a* to 56*d*, the connecting members 57*a* to 57*d*, the belts 58, and the gears 59 of the embodiments shown in FIGS. 13 to 16. The driven members are positioned and rotated in exactly the same manner as shown in FIG. 15. It is to be noted that in FIG. 18 the fourth connecting member 57*d* is provided on both ends of the drum 12 since the drum 11 is different in orientation from the developing device 33 to the cleaning device 37 and has to be connected to the fourth drive shaft 56*d* in either case, while in FIG. 14 the connecting member 57*d* is provided on only one end of the drum 12.

Figure 19:
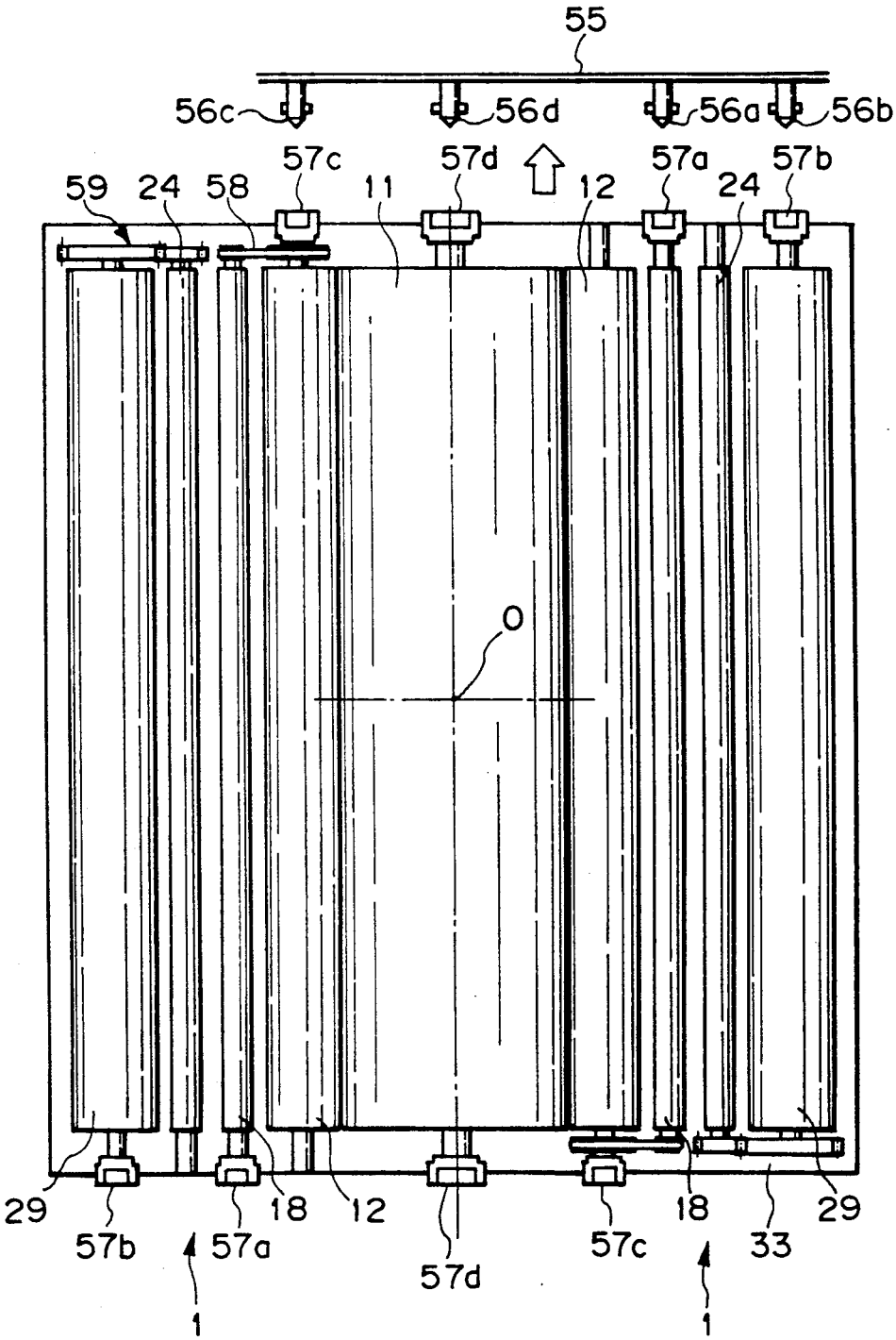
FIG. 19 is a plan view similar to FIG. 16 and also associated with the arrangement of FIG. 17.

In the embodiment of FIG. 17, the connecting member 57*c* may be provided on one end of the sleeve 12, as in the embodiment of FIG. 13. Such a configuration is shown in FIG. 19. In FIG. 19, the same parts and elements as those shown in FIGS. 14 and 16 are designated by like reference numerals, and redundant description will be avoided for simplicity.

Figure 20:
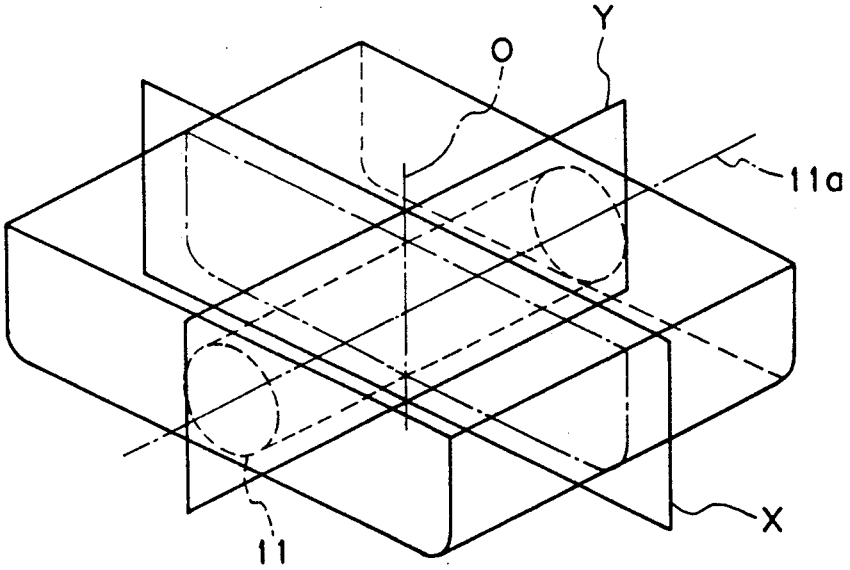
FIG. 20 is a schematic view indicative of a line of symmetry relating to the arrangement of drivable connections which are applicable to two toner handling units constructed into a unit.

FIG. 20 schematically shows a specific approach to facilitate the interchange of the developing device 33 and the cleaning device 37 of the cartridge 1' shown in FIG. 3 or 17. As shown, the cartridge 1' has a symmetrical configuration with respect to a line O where a vertical section Y containing the axis 11*a* of the image carrier or drum 11 and a vertical section X containing the center of the device 1 and perpendicular to the axis 11*a* intersect each other. In such a configuration, the developing device 33 and the cleaning device 37 will be readily replaced with each other if the cartridge 1' is turned 180 degrees about the line of intersection O. The connecting members provided on the shafts which are connectable to the drive shafts 56*a* to 56*d* of the drive mechanism 55 may also be arranged symmetrically with respect to the line of intersection O to facilitate and insure the connection to the mechanism 55.

In the drive mechanism 55, the drive shafts for driving the drum 11, developing device 33 and cleaning device 37 may be separated and connected to the latter independently of one another. Then, the predetermined directions of rotation will be insured despite the interchange of the two devices 33 and 37.

When the image forming device 1 is used as the cleaning device 37, impurities such as paper dust and the carrier that forms the magnet brush 14 are apt to enter the toner collected by the toner collecting roller 18. These impurities have to be removed since they would degrade the quality of images when the device 1 is used as the developing device 33 afterwards. As shown in FIG. 1, a net 60 for collecting the impurities extends across the path along which the toner scraped off by the blade 21 flows toward the toner tank 27. The net 60 has a mesh size which passes a toner whose particle size is 5 microns to 15 microns, for example, but does not pass a carrier whose particle size is 70 microns to 100 microns. As also shown in FIG. 1, an elastic member 62 is held in contact with the toner collecting roller 18 to prevent the toner from being fed directly from the toner tank 23 to the sleeve 12 without the intermediary of the toner supply roller 24. Likewise, an elastic member 62 is held in contact with the toner collecting roller 18 to prevent the toner collected from the magnet brush 14 from being scraped off and scattered around to the outside of the toner tank 23. Implementing a sealing function as stated, the elastic members 61 and 62 each may be constituted by an about 0.1 millimeter thick sheet of silicone rubber by way of example.

In summary, image forming equipment in accordance with the present invention has various advantages, as enumerated below.

(1) A developing device and a cleaning device both are implemented as image forming devices having an identical construction, i.e., identical parts and interchangeable with each other, whereby the number of required parts is reduced. A toner collected by the cleaning device is reused by the developing device when the two devices are replaced with each other. This eliminates the need for a complicated structure for reusing the collected toner and thereby reduces the number of parts while enhancing the reliability of operation.

(2) Since the toner is reused as stated above, the image forming devices can be interchanged and used a number of times and, therefore, over a long period of time.

(3) An image forming device which has run out of toner or does not have a sufficient amount of toner is prevented from being set in a developing position. This eliminates an occurrence that the image quality is degraded due to low toner density or the deposition of carrier on a photoconductive drum.

(4) When the image forming devices are constructed into a unit together with an image carrier and respectively located in a developing position and a cleaning position, the developing device and the cleaning device can be replaced by a single operation so that the image carrier and magnet brush are protected against damage. Moreover, the developing device and cleaning device can be readily and surely connected to a drive mechanism which is mounted on the equipment body. Predetermined directions in which various driven members should rotate are insured without resorting to special operations even when the developing device and the cleaning device are replaced with each other. In addition, a member which is rotated at the developing position is prevented from rotating in the cleaning position, thereby enhancing the cleaning ability.

(5) A net for collecting impurities is interposed between toner collecting means and a toner tank disposed in the image forming device. With such a simple implementation, it is possible to prevent impurities from being mixed with the toner to be reused. Hence, the toner supply roller and its neighborhood is protected against damage due to impurities, while images are free from disturbance otherwise caused by impurities.

(6) An elastic member is held in contact with each of the toner supply means and toner collecting means to prevent the toner from being scattered around to the outside of the toner tank in the event when the image forming device is mounted or dismounted.

Various modifications will become possible for those skilled in the art after receiving the teachings of the present disclosure without departing from the scope thereof.

What is claimed is:

1. In an image forming apparatus having an area for electrostatically forming a latent image on an image carrier, an area for developing said latent image to produce a toner image, an area for transferring said toner image to a recording medium, and an area for cleaning said image carrier to remove a residual toner remaining on said image carrier after the transfer of said toner image, a first toner handling unit comprising:

a magnet brush roller;

a toner storing section storing a toner therein;

toner collecting means for collecting said toner in said toner storing section;

toner supplying means for supplying said toner from said toner storing section to said magnet brush roller;

toner sensing means for sensing the toner stored in said toner storing section; and means for inhibiting said first toner handling unit from being located in said area for forming a toner image in response to an output of said toner sensing means which indicates that the toner does not exist in said toner storing means;

wherein said toner handling unit is constructed so as to be selectively set in either of said area for forming a toner image and said area for cleaning said image carrier;

wherein said toner handling unit functions as a developing device when said unit is set in said area for forming a toner image; and wherein said toner handling unit functions as a cleaning device when said unit is set in said area for cleaning said image carrier.

2. In an image forming apparatus having an area for electrostatically forming a latent image on an image carrier, an area for developing said latent image to produce a toner image, an area for transferring said toner image to a recording medium, and an area for cleaning said image carrier to remove a residual toner remaining on said image carrier after the transfer of said toner image, a first toner handling unit comprising:

a magnet brush roller;

a toner storing section storing a toner therein;

toner collecting means for collecting said toner in said toner storing section; and toner supplying means for supplying said toner from said toner storing section to said magnet brush roller;

wherein said toner handling unit is constructed so as to be selectively set in either of said area for forming a toner image and said area for cleaning said image carrier;

wherein said toner handling unit functions as a developing device when said unit is set in said area for forming a toner image;

wherein said toner handling unit functions as a cleaning device when said unit is set in said area for cleaning said image carrier; and wherein said first toner handling unit further comprises a net interposed between said toner collecting means and said toner storing section for collecting impurities.

3. In an image forming apparatus having an area for electrostatically forming a latent image on an image carrier, an area for developing said latent image to produce a toner image, an area for transferring said toner image to a recording medium, and an area for cleaning said image carrier to remove a residual toner remaining on said image carrier after the transfer of said toner image, a first toner handling unit comprising:

a magnet brush roller;

a toner storing section storing a toner therein;

toner collecting means for collecting said toner in said toner storing section; and toner supplying means for supplying said toner from said toner storing section to said magnet brush roller;

wherein said toner handling unit is constructed so as to be selectively set in either of said area for forming a toner image and said area for cleaning said image carrier;

wherein said toner handling unit functions as a developing device when said unit is set in said area for forming a toner image;

wherein toner handling unit functions as a cleaning device when said unit is set in said area for cleaning said image carrier;

wherein said toner collecting means includes a toner collecting roller and said toner supplying means includes a toner supply roller; and wherein said first toner handling unit further comprises an elastic member contacting said toner collecting roller and an elastic member contacting said toner supply roller.

* * * * *